US010210811B2

(12) United States Patent
Lee

(10) Patent No.: US 10,210,811 B2
(45) Date of Patent: Feb. 19, 2019

(54) PIXEL AND ORGANIC LIGHT EMITTING DISPLAY DEVICE USING THE SAME

(71) Applicant: SAMSUNG DISPLAY CO., LTD., Yongin, Gyeonggi-Do (KR)

(72) Inventor: Chang-Ho Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 111 days.

(21) Appl. No.: 14/683,062

(22) Filed: Apr. 9, 2015

(65) Prior Publication Data

US 2015/0356921 A1 Dec. 10, 2015

(30) Foreign Application Priority Data

Jun. 10, 2014 (KR) ..... 10-2014-0070302

(51) Int. Cl.
*G09G 3/30* (2006.01)
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0814* (2013.01); *G09G 2300/0819* (2013.01); *G09G 2300/0852* (2013.01); *G09G 2300/0861* (2013.01); *G09G 2310/0262* (2013.01); *G09G 2310/08* (2013.01);

(Continued)

(58) Field of Classification Search
CPC .. G09G 3/3225; G09G 3/3258; G09G 3/3266; G09G 3/3291; G09G 3/3233; G09G 2310/0208; G09G 2310/0218; G09G 2310/0262; G09G 2310/08; G09G 2320/0233; G09G 2320/0295; G09G 2320/045; G09G 2320/043; G09G 2320/0238; G09G 2340/16; G09G 2300/0814; G09G 2300/0819; G09G 2300/0852; G09G 2300/0861
USPC ..... 345/76–83, 699
See application file for complete search history.

(56) References Cited

U.S. PATENT DOCUMENTS

2006/0139266 A1 6/2006 Choi
2007/0124633 A1* 5/2007 Kim ..... G09G 3/2003 714/726

(Continued)

FOREIGN PATENT DOCUMENTS

KR 10-2006-0073681 A 6/2006
KR 10-2012-0012597 A 2/2012

(Continued)

*Primary Examiner* — Jimmy H Nguyen
(74) *Attorney, Agent, or Firm* — Lewis Roca Rothgerber Christie LLP

(57) ABSTRACT

Disclosed is a pixel for improving an image quality. A pixel includes: an organic light emitting diode; a first transistor to control a current supplied to the organic light emitting diode from a first power source connected to a first electrode of the first transistor in response to a voltage applied to a first node; a second transistor connected between the first node and a second node, and turned on when a scan signal is supplied to a scan line; a first capacitor connected between the second node and a data line; and a third transistor connected between a second electrode of the first transistor and the second node, and turned on when a common control signal is supplied to a common control line.

12 Claims, 4 Drawing Sheets

(52) U.S. Cl.
CPC ..... *G09G 2320/0233* (2013.01); *G09G 2320/043* (2013.01); *G09G 2320/045* (2013.01)

(56) References Cited

U.S. PATENT DOCUMENTS

| | | | | |
|---|---|---|---|---|
| 2008/0043005 | A1* | 2/2008 | Kanda | G09G 3/3233 345/204 |
| 2012/0026145 | A1 | 2/2012 | Jeong | |
| 2012/0075259 | A1 | 3/2012 | Chung | |
| 2012/0169574 | A1* | 7/2012 | Kim | G09G 3/3233 345/76 |
| 2013/0169702 | A1* | 7/2013 | Ono | G09G 5/10 345/690 |
| 2013/0335391 | A1* | 12/2013 | Kim | G09G 3/3291 345/211 |
| 2014/0347347 | A1 | 11/2014 | Jeong et al. | |

FOREIGN PATENT DOCUMENTS

| | | | |
|---|---|---|---|
| KR | 10-2012-0032274 | A | 4/2012 |
| KR | 10-2014-0137504 | A | 12/2014 |

* cited by examiner

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2014-0070302, filed on Jun. 10, 2014, in the Korean Intellectual Property Office, the contents of which are incorporated herein by reference in their entirety.

BACKGROUND

1. Field

Embodiments of the present invention relate to a pixel and an organic light emitting display device using the same.

2. Description of the Related Art

According to development of information technology, the importance of a display device, which is a connection medium between a user and information, has been increased. In this respect, use of a Flat Panel Display (FPD), such as a Liquid Crystal Display Device (LCD), an Organic Light Emitting Display Device (OLED), and a Plasma Display Panel (PDP), has increased.

The organic light emitting display device among the FPDs displays an image by using an organic light emitting diode which emits light by recombination of electrons and holes, and has an advantage in that the organic light emitting display device has a fast response speed and low power consumption.

SUMMARY

Embodiments of the present invention can be used to provide a pixel for improving an image quality by stably compensating for a threshold voltage of a driving transistor, and an organic light emitting display device using the same.

An example embodiment of the present invention provides a pixel, including: an organic light emitting diode; a first transistor to control a current supplied to the organic light emitting diode from a first power source connected to a first electrode of the first transistor in response to a voltage applied to a first node; a second transistor connected between the first node and a second node, and turned on when a scan signal is supplied to a scan line; a first capacitor connected between the second node and a data line; and a third transistor connected between a second electrode of the first transistor and the second node, and turned on when a common control signal is supplied to a common control line.

The pixel may further include: a second capacitor connected between the first node and the first power source; a fourth transistor connected between an anode electrode of the organic light emitting diode and an initialization power source, and turned on when the common control signal is supplied; and a fifth transistor connected between the second electrode of the first transistor and the anode electrode of the organic light emitting diode, and turned off when a light emission control signal is supplied to a light emission control line and turned on in other cases.

A turn-on period of the second transistor may not overlap a turn-on period of the fifth transistor.

A turn-on period of the third transistor partially may overlap turn-on periods of the second transistor and the fifth transistor.

Another example embodiment of the present invention provides an organic light emitting display device, including:

pixels positioned in regions divided by scan lines and data lines; at least two blocks divided so as to include two or more scan lines; a control driver to supply a common control signal to common control lines wherein each block comprises a common control line, and supply a light emission control signal to light emission control lines wherein each block comprises a light emission control line; a scan driver to supply a scan signal to the scan lines; and a data driver to supply a data signal to the data lines, wherein the common control signal supplied to a $j^{th}$ common control line in a $j^{th}$ block overlaps one or more scan signals supplied to the scan lines in a $j-1^{th}$ block.

The scan driver may simultaneously supply the scan signal to the scan lines in the $j^{th}$ block, and sequentially stop the supply of the scan signal to the scan lines in the $j^{th}$ block.

The data driver may supply the data signal to the data lines so as to be synchronized with the sequentially stopped scan signals.

The scan signal may be simultaneously supplied to the scan lines positioned in the $j^{th}$ block after the common control signal is supplied to the $j^{th}$ common control line.

The supply of the scan signal to the scan lines positioned in the $j^{th}$ block may be sequentially stopped after the supply of the common control signal to the $j^{th}$ common control line is stopped.

A light emission control signal supplied to a $j^{th}$ light emission control line positioned in the $j^{th}$ block may overlap the scan signal supplied to the scan lines positioned in the $j^{th}$ block.

The scan driver and the control driver may be one driving unit.

The one driving unit may include: a shift register unit positioned in each of the blocks to generate sampling signals in response to external first control signals; a common control signal generation unit positioned in each of the blocks to generate the common control signal in response to the sampling signals; a light emission control signal generation unit positioned in each of the blocks to generate the light emission control signal in response to external second control signals; and a buffer unit positioned in each of the blocks to generate the scan signals in response to the sampling signals.

The common control signal generation unit positioned in a first block may receive sampling signals from the shift register unit positioned in the same block, and the common control signal generation units positioned in the blocks except for the first block may receive the sampling signals from the shift register unit positioned in a previous block.

Each of the pixels positioned in the $j^{th}$ block may include: an organic light emitting diode; a first transistor to control a current supplied to the organic light emitting diode from a first power source connected to a first electrode of the first transistor in response to a voltage applied to a first node; a second transistor connected between the first node and a second node, and turned on when the scan signal is supplied to the scan line; a first capacitor connected between the second node and a data line; and a third transistor connected between a second electrode of the first transistor and the second node, and turned on when the common control signal is supplied to the $j^{th}$ common control line.

The pixel may further include: a second capacitor connected between the first node and the first power source; a fourth transistor connected between an anode electrode of the organic light emitting diode and an initialization power source, and turned on when the common control signal is supplied to the $j^{th}$ common control line; and a fifth transistor connected between the second electrode of the first transistor and the anode electrode of the organic light emitting diode, and turned off when the light emission control signal is supplied to a $j^{th}$ light emission control line and turned on in other cases.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the present invention to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Hereinafter, an example embodiment, which those skilled in the art may easily implement, will be described in detail with reference to accompanying FIGS. 1 to 4.

Figure 1:
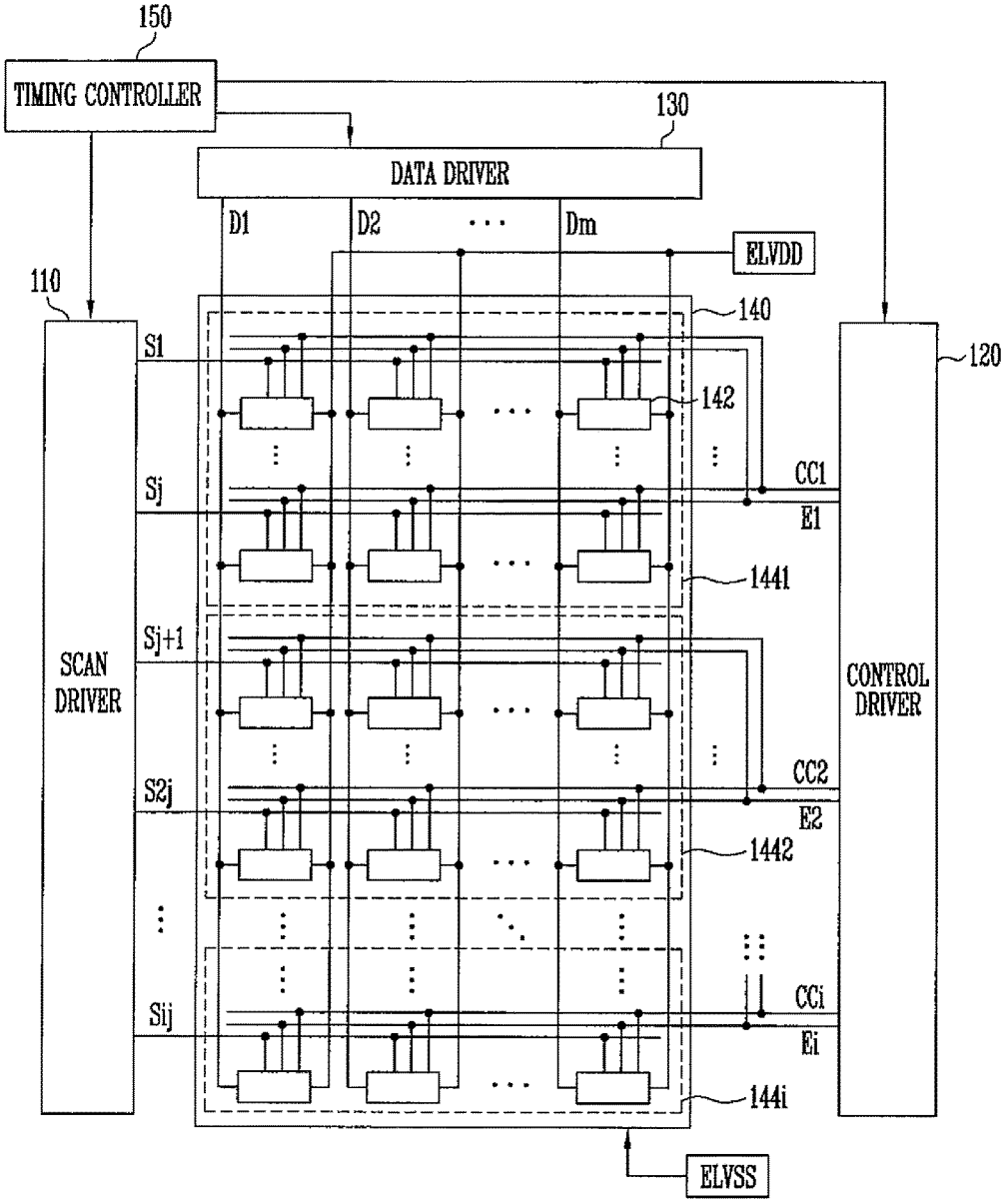
FIG. 1 is a diagram illustrating an organic light emitting display device according to an embodiment of the present invention.

FIG. 1 is a diagram illustrating an organic light emitting display device according to an embodiment of the present invention.

Referring to FIG. 1, an organic light emitting display device according to an embodiment of the present invention includes a pixel unit 140 including pixels 142 positioned in regions divided by scan lines S1 to Sij and data line D1 to Dm, i blocks 1441 to 144*i* divided so as to include two or more scan lines (i is a natural number equal to or greater than 2), a scan driver 110 for driving the scan lines S1 to Sij, a control driver 120 for driving common control lines CC1 to CCi and light emission control lines E1 to Ei in respective blocks, a data driver 130 for driving the data lines D1 to Dm, and a timing controller 150 for controlling the drivers 110, 120, and 130.

The pixel unit 140 is divided into the i blocks 1441 to 144*i*. Each of the blocks 1441 to 144*i* includes the plurality of pixels 142, and the pixels 142 positioned in the same block simultaneously compensate for a threshold voltage of a driving transistor. Here, when the threshold voltage of the driving transistor is compensated in the unit of the block 1441 to 144*i*, a threshold voltage compensation time may be sufficiently allocated, thereby stably compensating for the threshold voltage of the driving transistor.

One common control line (any one of CC1 to CCi) and one light emission control line (any one of E1 to Ei) are in each block (any one of 1441 to 144*i*). To this end, i common control lines CC1 to CCi and i light emission control lines E1 to Ei are in the pixel unit 140. Further, a $k^{th}$ common control line CCk and a $k^{th}$ light emission control line Ek in a $k^{th}$ block (k is a natural number) are commonly connected with the pixels 142 positioned in a $k^{th}$ block.

The scan driver 110 supplies a scan signal to the scan lines S1 to Sij. Here, the scan driver 110 supplies a scan signal in the unit of the block. For example, the scan driver 110 simultaneously supplies the scan signal in the unit of the block, and sequentially stops the supply of the scan signal. Here, the scan signal is set as a voltage (for example, a low voltage) at which the transistors included in the pixels 142 may be turned on.

The control driver 120 sequentially supplies a common control signal to the common control lines CC1 to CCi, and sequentially supplies a light emission control signal to the light emission control lines E1 to Ei. Here, the control driver 120 supplies the light emission control signal to the $k^{th}$ light emission control line Ek so as to overlap the scan signal supplies to the scan lines positioned in the $k^{th}$ block. Further, the control driver 120 supplies the common control signal to the $k^{th}$ common control line CCk before the scan signal is supplied to the scan lines positioned in the $k^{th}$ block, and stops the supply of the common control signal to the $k^{th}$ common control line CCk before the supply of the scan signal to the scan lines positioned in the $k^{th}$ block is stopped.

In addition, the control driver 120 supplies the common control signal to the kth common control line CCk so as to overlap the scan signal supplied to one or more scan lines in a $k-1^{th}$ block. When the common control signal supplied to the $k^{th}$ common control line CCk overlaps one or more scan signals supplied to the $k-1^{th}$ block, it is possible to additionally secure a time necessary for driving. This will be described in detail below.

The common control signal supplied from the control driver 120 is set as a voltage at which the transistors included in the pixels 142 may be turned on, the light emission control signal is set as a voltage (for example, a high voltage) at which the transistors included in the pixels 142 may be turned off.

The data driver 130 supplies the data signal to the data lines D1 to Dm in response to the scan signal the supply of which is sequentially stopped in the unit of the block. Then, a voltage according to the data signal is stored in the pixels 142 selected by the scan signal. In addition, the data driver 130 may supply a specific voltage within a voltage range of the data signal to the data lines D1 to Dm for a period, for which the data signal is not supplied, for the driving stability.

The pixels 142 are positioned in the regions divided by the scan lines S1 to Sij and the data lines D1 to Dm. The pixels 142 generates light (e.g., light with predetermined luminance) while controlling the current flowing to a second power source ELVSS from a first power source ELVDD via an organic light emitting diode OLED in response to the data signal.

The timing controller 150 controls the scan driver 110, the control driver 120, and the data driver 130.

It is described that the common control lines CC1 to CCi and the light emission control lines E1 to Ei are driven by the control driver 120, but embodiments of the present invention are not limited thereto. For example, the scan driver 110 and the control driver 120 may be one driving unit in order to share shift registers.

Figure 2:
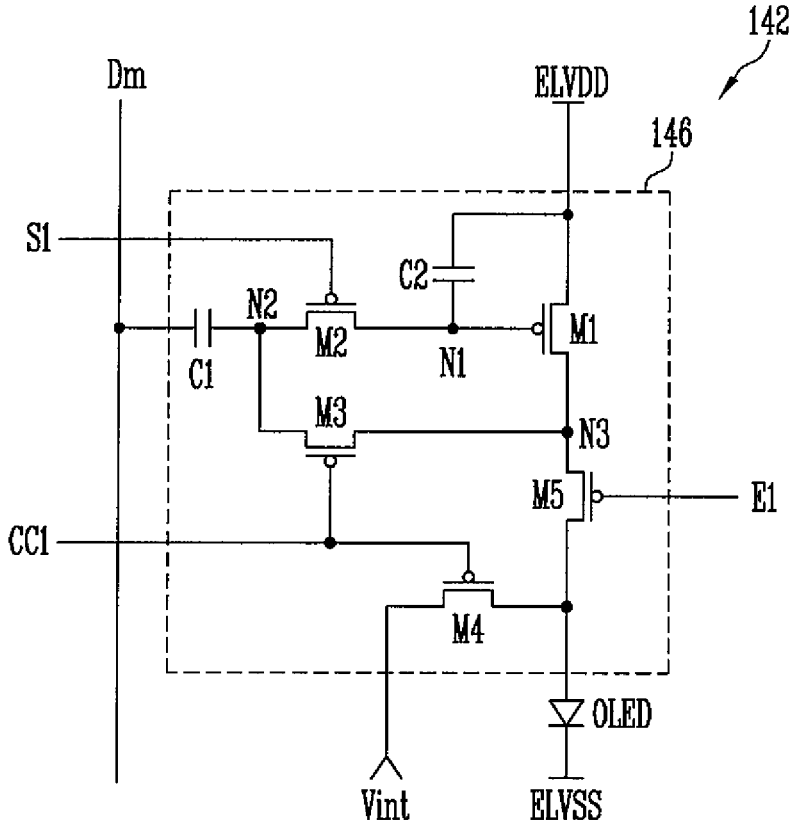
FIG. 2 is a diagram illustrating a pixel according to the embodiment of the present invention.

FIG. 2 is a diagram illustrating the pixel according to the embodiment of the present invention. For convenience of the description, FIG. 2 illustrates a pixel connected to the $m^{th}$ data line Dm and the first scan line S1.

Referring to FIG. 2, the pixel 142 according to the example embodiment of the present invention includes the organic light emitting diode OLED and a pixel circuit 146 for controlling the current supplied to the organic light emitting diode OLED.

An anode electrode of the organic light emitting diode OLED is connected to the pixel circuit 146, and a cathode electrode is connected to the second power source ELVSS. The organic light emitting diode OLED generates light (e.g., light with predetermined luminance) in response to the current supplied from the pixel circuit 146. The second power source ELVSS is set as a lower voltage than the first power source ELVDD so that the current may flow in the organic light emitting diode OLED.

The pixel circuit 146 controls the current supplied to the organic light emitting diode OLED in response to the data signal. To this end, the pixel circuit 146 includes a first transistor M1 to a fifth transistor M5, a first capacitor C1, and a second capacitor C2.

A first electrode of the first transistor M1 (driving transistor) is connected to the first power source ELVDD, and a second electrode thereof is connected to a third node N3. Further, a gate electrode of the first transistor M1 is connected to a first node N1. The first transistor M1 controls the current flowing to the second power source ELVSS from the first power source ELVDD via the third node N3 and the organic light emitting diode OLED in response to the voltage applied to the first node N1.

The second transistor M2 is connected between the first node N1 and a second node N2. Further, a gate electrode of the second transistor M2 is connected to the scan line S1. The second transistor M2 is turned on when the scan signal is supplied to the scan line S1 to electrically connect the first node N1 and the second node N2.

The third transistor M3 is connected between the second node N2 and a third node N3. Further, a gate electrode of the third transistor M3 is connected to the common control line CC1. The third transistor M3 is turned on when the common control signal is supplied to the common control line CC1 to electrically connect the second node N2 and the third node N3.

The fourth transistor M4 is connected between the anode electrode of the organic light emitting diode OLED and an initialization power source Vint. Further, a gate electrode of the fourth transistor M4 is connected to the common control line CC1. The fourth transistor M4 is turned on when the common control signal is supplied to the common control line CC1 to supply a voltage of the initialization power source Vint to the anode electrode of the organic light emitting diode OLED. Here, the initialization power source Vint may be set as a low voltage, for example, a voltage at which the organic light emitting diode OLED may be turned off, so that an organic capacitor (not shown) equivalently formed in the organic light emitting diode (OLED) may be discharged.

A fifth transistor M5 is connected between the third node N3 and the anode electrode of the organic light emitting diode OLED. Further, a gate electrode of the fifth transistor M5 is connected to the light emission control line E1. The fifth transistor M5 is turned off when the light emission control signal is supplied to the light emission control line E1, and is turned on in other cases.

The first capacitor C1 is connected to the data line Dm and the second node N2. The first capacitor C1 stores a voltage of the data signal supplied to the data line Dm.

The second capacitor C2 is connected between the first node N1 and the first power source ELVDD. The second capacitor C2 stores a voltage of the data signal supplied to the first capacitor C1.

Figure 3:
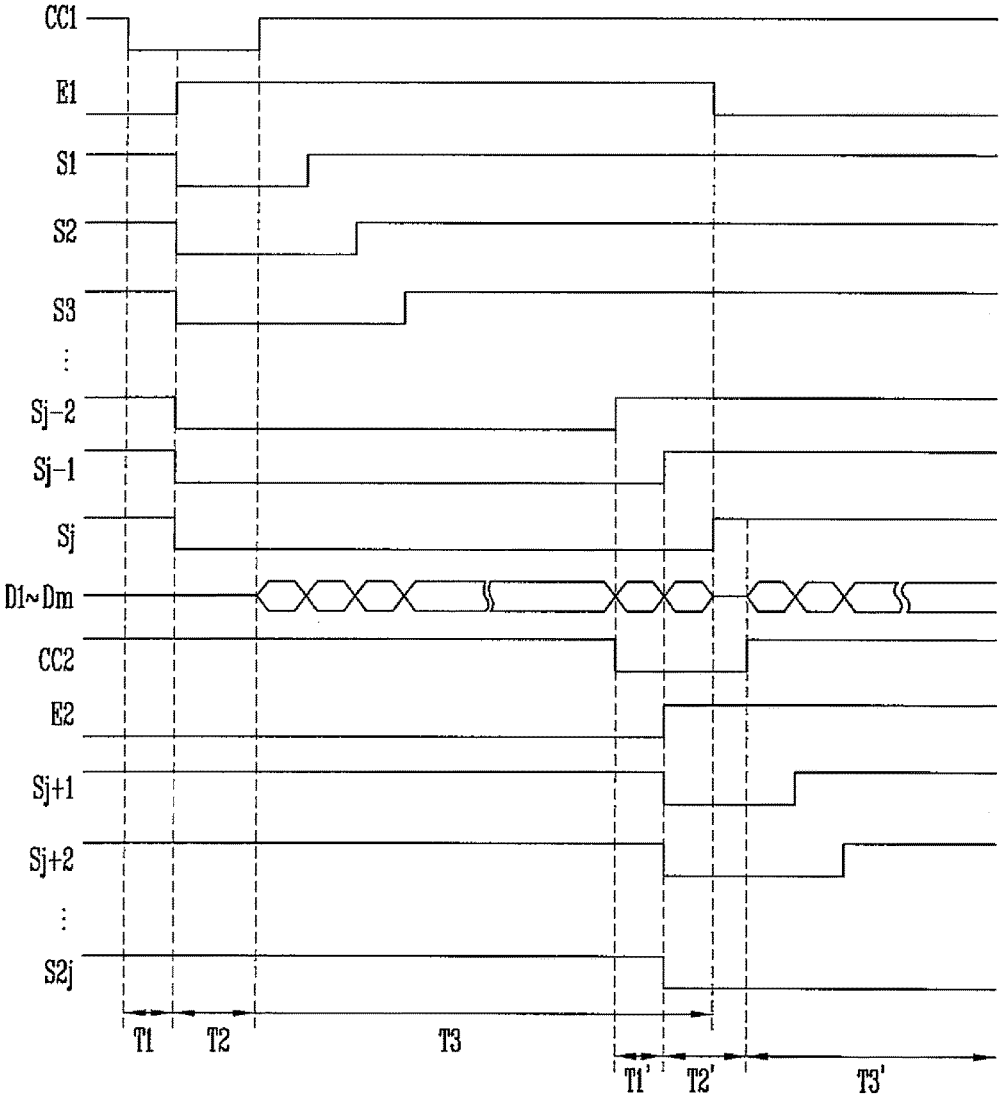
FIG. 3 is a waveform diagram illustrating a driving method according to the embodiment of the present invention.

FIG. 3 is a waveform diagram illustrating a driving method according to the embodiment of the present invention. For convenience of the description, FIG. 3 illustrates a driving waveform supplied to the first block 1441 and the second block 1442.

Referring to FIG. 3, the common control signal is supplied (e.g., supplied at a low level) to the first common control line CC1 for a first period T1 and a second period T2 in the period for which the driving waveform is supplied (e.g., supplied at a low level) to the first block 1441. When the common control signal is supplied (e.g., supplied at a low level) to the first common control line CC1, the third transistor M3 and the fourth transistor M4 of each of the pixels 142 positioned in the first block 1441 are turned on.

When the third transistor M3 is turned on, the second node N2 and the third node N3 are electrically connected.

When the fourth transistor M4 is turned on, the voltage of the initialization power source Vint is supplied (e.g., supplied at a low level) to the anode electrode of the organic light emitting diode OLED, and thus, the organic light emitting diode OLED is initialized. Since the fifth transistor M5 in the turned-on state for the first period T1, the voltage of the initialization power source Vint is supplied (e.g., supplied at a low level) to the second node N2 via the fifth transistor M5, the third node N3, and the third transistor M3. Then, the second node N2 is initialized with the voltage of the initialization power source for the first period T1.

The scan signal is simultaneously supplied (e.g., supplied at a low level) to the scan lines S1 to Sj for the second period T2. When the scan signal is simultaneously supplied to the scan lines S1 to Sj, the second transistor M2 of each of the pixels 142 positioned in the first block 1441 is turned on.

When the second transistor M2 is turned on, the first node N1 and the second node N2 are electrically connected. When the first node N1 and the second node N2 are electrically connected, the first transistor M1 is connected in the form of the diode. When the first transistor M1 is connected in the form of the diode, a voltage obtained by subtracting an absolute threshold voltage of the first transistor M1 from the voltage of the first power source ELVDD may be applied to the first node N1. Accordingly, a voltage according to the threshold voltage of the first transistor M1 is stored in the second capacitor C2 for the second period T2. That is, in embodiments of the present invention, the threshold voltage is compensated in the unit of the block, and thus, a sufficient time may be allocated to the second period T2 so that the threshold voltage may be stably compensated.

Then, the supply of the common control signal to the first common control line CC1 is stopped (e.g., supplied at a high level) for a third period T3, and thus the third transistor M3 and the fourth transistor M4 of each of the pixels 142 positioned in the first block 1441 are turned off. Then, the supply of the scan signal supplied to the scan lines S1 to Sj is sequentially stopped (e.g., supplied at a high level) for the third period T3, and the data signal is supplied to the data lines D1 to Dm so as to correspond to the scan signal of which the supply is sequentially stopped (e.g., supplied at a high level).

Particularly, the data signal according to a first horizontal line is supplied to the data lines D1 to Dm for the period in the third period T3 for which the scan signal is supplied to the scan lines S1 to Sj. Then, the voltage of the data signal according to the first horizontal line is stored in the first capacitor C1 and the second capacitor C2 of each of the pixels 142 positioned in the first block 1441. For example, when the data signal is supplied to the data lines D1 to Dm, the voltage of the second node N2 is changed in accordance with a ratio of the first capacitor C1 and the second capacitor C2. In this case, the second node N2 has a voltage (e.g., a predetermined voltage) in accordance with the voltage according to the threshold voltage stored for the second period T2 and the voltage of the data signal.

Then, the supply of the scan signal to the first scan line S1 is stopped (e.g., supplied at a high level), and the scan signal is supplied (e.g., supplied at a low level) to the second to $j^{th}$ scan lines S2 to Sj. The data signal corresponding to a second horizontal line is supplied to the data lines D1 to Dm for the period for which the scan signal is supplied to the second to $j^{th}$ scan lines S2 to Sj. Then, the voltage of the data signal corresponding to the second horizontal line is stored in the first capacitor C1 and the second capacitor C2 of each of the pixels 142 positioned in the second horizontal line to the $j^{th}$ horizontal line positioned in the first block 1441.

The second transistor M2 included in each of the pixels 142 positioned in the first horizontal line for the period for which the data signal corresponding to the second horizontal line is supplied in a turned-off state, and thus, the second capacitor C2 of each of the pixels 142 positioned in the first horizontal line stably maintains a voltage charged for a previous period.

Similarly, the pixels 142 positioned in the third horizontal line to the $j^{th}$ horizontal line stores voltages of the desired data signals in response to the sequential stop of the supply of the scan signal supplied to the third to $j^{th}$ scan lines S3 to Sj.

In embodiments of the present invention, the third period T3 of the first block 1441 overlaps at least a part of a first period T1' and a second period T2' of the second block 1442. That is, the common control signal supplied (e.g., supplied at a low level) to the second common control line CC2 overlaps one or more scan signals supplied (e.g., supplied at a low level) to the first block. In this case, the pixels 142 included in the second block 1442 are initialized (that is, the second node N2 is initialized) and the threshold voltages of the driving transistor is compensated for the period for which the data signal is stored in the pixels 142 included in the first block 1441. Then, it is possible to maximally secure a time necessary for the driving, thereby further improving a display quality.

In addition, the data driver 130 may supply the same voltage to the data lines D1 to Dm for the period for which the data signal is not supplied to the data lines D1 to Dm. For example, the data driver 130 supplies a specific voltage within the voltage range of the data signal to the data lines D1 to Dm. Thus, it is possible to prevent properties of the pixels 142 from being non-uniform due to non-uniformity of the voltage of the data line Dm.

Figure 4:
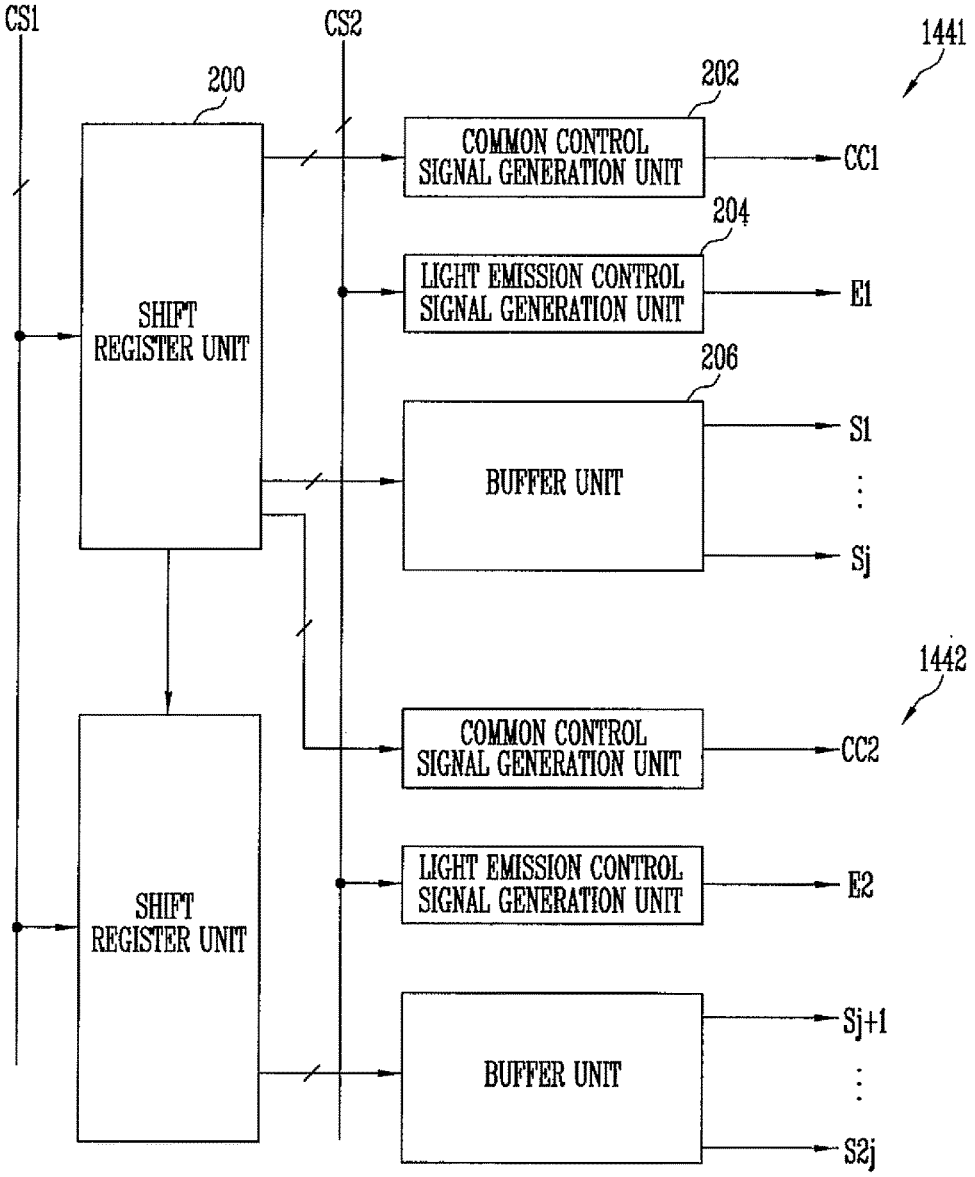
FIG. 4 is a block diagram illustrating a case where a scan driver and a control driver are one driving unit.

FIG. 4 is a block diagram illustrating a case where the scan driver and the control driver are one driving unit.

Referring to FIG. 4, one driving unit includes a shift register unit 200, a common control signal generation unit 202, a light emission control signal generation unit 204, and a buffer unit 206 which are in each block. The shift register unit 200 generates sampling signals which are sequentially shifted in response to the first control signals CS1 supplied from the outside (e.g., supplied from the timing controller 150) and supplies the generated sampling signals to the common control signal generation unit 202 and the buffer unit 206.

The common control signal generation unit 202 generates the common control signal in response to the sampling signals supplied from the shift register unit 200, and supplies the generated common control signal to the common control line (any one of CC1 to CCi) connected with the common control signal generation unit 202.

The light emission control signal generation unit 204 generates the light emission control signal in response to the second control signals CS2 supplied from the outside (e.g., supplied from the timing control unit 150) and supplies the generated light emission control signal to the light emission control line (any one of E1 to Ei) connected with the light emission control signal generation unit 204. Here, since the light emission control signal generation unit 204 generates a high voltage, the light emission control signal generation unit 204 receives the second control signals CS2 from the outside, but embodiments of the present invention are not limited thereto. For example, in the example embodiment of the present invention, the sampling signal supplied from the shift register unit 200 may be reversed to be supplied to the light emission control signal generation unit 204.

The buffer unit 206 generates the scan signal in response to the sampling signal supplied from the shift register unit 200, and supplies the generated scan signal to the scan lines in the unit of the block. For example, the buffer unit 206 may include buffers connected with the scan lines, respectively, in the unit of the block. The buffers supply the received sampling signal to the connected scan lines as the scan signals.

In embodiments of the present invention, the common control signal generation unit 202 positioned in the first block receives the sampling signals from the shift register unit 200 positioned in the same block. However, the common control signal generation units positioned in the remaining blocks except for the first block receive the sampling signals from the shift register unit positioned in a previous block. In this case, the common control signal may be supplied to the $k^{th}$ common control line CCk so as to overlap the scan signal supplied to one or more scan lines in the $k-1^{th}$ block as in the driving waveform illustrated in FIG. 3.

In embodiments of the present invention, it is illustrated that the transistors are the PMOSs for convenience of the description, but embodiments of the present invention are not limited thereto. That is, the transistors may be NMOSs.

Further, in embodiments of the present invention, the organic light emitting diode OLED may generate light of red, green, or blue or light of white in accordance with the current. When the organic light emitting diode OLED generates white light, it is possible to implement a color image by using a separate color filter and the like.

The organic light emitting display device includes the plurality of pixels arranged in the matrix form in crossing portions of the plurality of data lines, the plurality of scan lines, and the plurality of power supply lines. The pixel generally includes two or more transistors and one or more capacitors including the organic light emitting diode and the driving transistor.

The organic light emitting display device has an advantage in that power consumption is low, but the current flowing to the organic light emitting diode is changed according to a deviation of a threshold voltage of the driving transistor included in each of the pixels, and thus display non-uniformity may be caused. That is, a property of the driving transistor is changed according to a manufacturing process variable of the driving transistor included in each of the pixels. Actually, it is impossible to manufacture all of the transistors of the organic light emitting display device having the same property in a current processing stage, so that a deviation of the threshold voltage of the driving transistor is generated.

In order to solve the problem, a method of adding a compensation circuit including the plurality of transistors and capacitors to each of the pixels is suggested. The compensation circuit included in each of the pixels charges a voltage according to the threshold voltage of the driving transistor for the first horizontal period, thereby compensating for the deviation of the threshold voltage of the driving transistor. However, a time allocated to the first horizontal is decreased according to an increase of resolution of the panel, and thus the threshold voltage of the driving transistor is not compensated by a desired level.

According to example embodiments of the present invention and the organic light emitting display device using the same, the panel is divided into the plurality of blocks, and the threshold voltage of the driving transistor included in each of the pixels is compensated in the unit of the block. In the case where the threshold voltage of the driving transistor is compensated in the unit of the block, it is possible to sufficiently secure a threshold voltage compensation time, thereby stably compensating for the threshold voltage. In addition, in the example embodiment of the present invention, it is possible to compensate for the threshold voltages of the pixels included in the current block for the data signal charging period of the pixels included in the previous block, thereby sufficiently securing a driving time.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A pixel, comprising:

an organic light emitting diode;

a first transistor to control a current supplied to the organic light emitting diode from a first power source connected to a first electrode of the first transistor in response to a voltage applied to a first node;

a second transistor connected between the first node and a second node, and turned on when a scan signal is supplied to a scan line at a low level;

a first capacitor connected between the second node and a data line;

a third transistor directly connected between a second electrode of the first transistor and the second node, and turned on when a common control signal is supplied to a common control line at the low level;

a fourth transistor connected between an anode electrode of the organic light emitting diode and an initialization power source, and turned on when the common control signal is supplied to a gate electrode of the fourth transistor; and a fifth transistor connected between the second electrode of the first transistor and the anode electrode of the organic light emitting diode, and turned off when a light emission control signal is supplied to a light emission control line at a high level and turned on when the light emission control signal is supplied at the low level, wherein only a first part of a turn-on period of the third transistor overlaps a turn-on period of the second transistor and only a second part of the turn-on period of the third transistor overlaps a turn-on period of the fifth transistor, wherein the second part of the turn-on period of the third transistor does not overlap all of the turn-on period of the second transistor.

2. The pixel of claim 1, further comprising:

a second capacitor connected between the first node and the first power source.

3. The pixel of claim 2, wherein a turn-on period of the second transistor does not overlap a turn-on period of the fifth transistor.

4. An organic light emitting display device, comprising:

pixels positioned in regions divided by scan lines and data lines;

at least two blocks divided so as to include two or more scan lines in each block;

a control driver to supply a respective common control signal of a plurality of common control signals to each of a plurality of common control lines, wherein each block comprises a different common control line of the plurality of common control lines, and to supply a respective light emission control signal of a plurality of light emission control signals to each of a plurality of light emission control lines, wherein each block comprises a different light emission control line of the plurality of light emission control lines, wherein the plurality of common control lines comprises three or more common control lines;

a scan driver to supply a respective scan signal of a plurality of scan signals to each of the scan lines; and a data driver to supply a respective data signal of a plurality of data signals to each of the data lines, wherein the control driver is further to supply the respective common control signal to a $j^{th}$ common control line in a $j^{th}$ block such that a low level of the respective common control signal supplied to the $j^{th}$ common control line overlaps with a low level of one or more of the respective scan signals supplied to the scan lines in a $j-1^{th}$ block, where j is a natural number greater than 1, wherein the plurality of common control signals are different from each other, and wherein one of the plurality of light emission control signals is supplied to all of the pixels of a corresponding block, and wherein each of the pixels positioned in the jth block includes:

an organic light emitting diode;

a first transistor to control a current supplied to the organic light emitting diode from a first power source connected to a first electrode of the first transistor in response to a voltage applied to a first node;

a second transistor connected between the first node and a second node, and turned on when the respective scan signal is supplied to the scan line at the low level;

a first capacitor connected between the second node and a data line;

a third transistor connected between a second electrode of the first transistor and the second node, and turned on when the respective common control signal is supplied to the jth common control line at the low level;

a second capacitor connected between the first node and the first power source;

a fourth transistor connected between an anode electrode of the organic light emitting diode and an initialization power source, and turned on when the respective common control signal is supplied to a gate electrode of the fourth transistor; and a fifth transistor connected between the second electrode of the first transistor and the anode electrode of the organic light emitting diode, and turned off when the respective light emission control signal is supplied to a jth light emission control line at a high level and turned on when the light emission control signal is supplied at the low level.

5. The organic light emitting display device of claim 4, wherein the scan driver simultaneously begins supplying the respective scan signals at the low level to the scan lines in the $j^{th}$ block, and sequentially begins supplying the respective scan signals at a high level to the scan lines in the $j^{th}$ block.

6. The organic light emitting display device of claim 5, wherein the data driver supplies the respective data signals to the data lines so as to be synchronized with the supplying of the respective scan signals at the high level.

7. The organic light emitting display device of claim 5, wherein respective scan signals are simultaneously supplied at the low level to the scan lines positioned in the $j^{th}$ block after the respective common control signal is supplied at the low level to the $j^{th}$ common control line.

8. The organic light emitting display device of claim 7, wherein the supply of the respective scan signals at the low level to the scan lines positioned in the $j^{th}$ block is sequentially stopped after the supply of the respective common control signal at the low level to the $j^{th}$ common control line is stopped.

9. The organic light emitting display device of claim 5, wherein the low level of the respective light emission control signal supplied to a $j^{th}$ light emission control line positioned in the $j^{th}$ block does not overlap the low level of the respective scan signals supplied to the scan lines positioned in the $j^{th}$ block.

10. The organic light emitting display device of claim 4, wherein the scan driver and the control driver are one driving unit.

11. The organic light emitting display device of claim 10, wherein the one driving unit includes:

a shift register unit positioned in each of the blocks to generate sampling signals in response to external first control signals;

a common control signal generation unit positioned in each of the blocks to generate the plurality of common control signals in response to the sampling signals;

a light emission control signal generation unit positioned in each of the blocks to generate the plurality of light emission control signals in response to external second control signals; and a buffer unit positioned in each of the blocks to generate the plurality of scan signals in response to the sampling signals.

12. The organic light emitting display device of claim 11, wherein the common control signal generation unit positioned in a first block receives sampling signals from the shift register unit positioned in the same block, and the common control signal generation units positioned in the blocks except for the first block receive the sampling signals from the shift register unit positioned in a previous block.

* * * * *